US011292041B2

(12) United States Patent
Galli et al.

(10) Patent No.: US 11,292,041 B2
(45) Date of Patent: Apr. 5, 2022

(54) PRESS FOR THE DIRECT EXTRUSION OF METALLIC MATERIAL

(71) Applicant: Danieli & C. Officine Meccaniche S.P.A., Buttrio (IT)

(72) Inventors: Alessandro Mario Galli, Costa Masnaga (IT); Mattia Merlini, Brescia (IT); Giacomo Calvetti, Passirano (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 190 days.

(21) Appl. No.: 16/719,783

(22) Filed: Dec. 18, 2019

(65) Prior Publication Data

US 2020/0197993 A1 Jun. 25, 2020

(30) Foreign Application Priority Data

Dec. 21, 2018 (IT) ..... 102018000020815

(51) Int. Cl.
*B21C 23/04* (2006.01)

(52) U.S. Cl.
CPC ..... *B21C 23/04* (2013.01)

(58) Field of Classification Search
CPC ..... B21C 23/04; B21C 23/14; B21C 23/212; B21C 23/214; B21C 23/215; B21C 25/02
See application file for complete search history.

(56) References Cited

U.S. PATENT DOCUMENTS 3,354,686 A * 11/1967 Petsch ..... B29C 48/256 72/263
3,543,557 A * 12/1970 Ernest ..... B21C 23/214 72/263

(Continued)

FOREIGN PATENT DOCUMENTS

DE 1127852 B * 4/1962 ..... B21C 23/212
DE 1602299 A1 11/1970

(Continued)

OTHER PUBLICATIONS

Translation; DE 1127852 B; Apr. 1962, Proett.*

*Primary Examiner* — Edward T Tolan

(74) *Attorney, Agent, or Firm* — Stetina Brunda Garred and Brucker

(57) ABSTRACT

The present invention relates to a press for the direct extrusion of metallic material, wherein the press comprises a supporting structure which defines an extrusion axis and a transverse direction orthogonal to said extrusion axis. The press further comprises an extrusion die and a die-holder drawer, in which said die is placed. Moving means are provided for moving said drawer along a transverse direction between a first position (P1), in which said die is aligned with said extrusion axis, and a second position in which, when reached, said die can be replaced. The press according to the invention further comprises a fixed supporting element which supports the drawer at least when it occupies the first position. The press further comprises at least a movable supporting element for supporting said drawer during the movement along said transverse direction; lifting means are provided for vertically lifting the movable supporting element between a first vertical position, in which the drawer is supported by the fixed supporting element, and a second vertical position, in which the drawer is lifted with respect to the fixed supporting element and supported by said at least one movable supporting element.

6 Claims, 7 Drawing Sheets

(56) References Cited

U.S. PATENT DOCUMENTS

| | | | | | |
|---|---|---|---|---|---|
| 3,798,953 | A * | 3/1974 | Sgambati | B21C 23/212 | 72/255 |
| 4,020,668 | A * | 5/1977 | Doudet | B21C 23/212 | 483/29 |
| 4,416,138 | A * | 11/1983 | Freese | B21C 23/214 | 72/255 |
| 4,781,053 | A * | 11/1988 | Stewart | B21C 23/218 | 72/273.5 |
| 4,856,314 | A * | 8/1989 | Zurru | B21C 23/212 | 72/263 |
| 2018/0015517 | A1 | 1/2018 | Yamamoto et al. | | |

FOREIGN PATENT DOCUMENTS

| | | | | |
|---|---|---|---|---|
| DE | 102015107308 | A1 * | 11/2016 | B21C 23/04 |
| EP | 3127622 | A1 | 2/2017 | |
| GB | 2070485 | A | 9/1981 | |

* cited by examiner

PRESS FOR THE DIRECT EXTRUSION OF METALLIC MATERIAL

FIELD OF THE INVENTION

The present invention relates to the manufacturing of items made of metallic material, either ferrous or non-ferrous, which may be aluminum section bars, for instance. In particular, the invention relates to a press for the direct extrusion of metallic material.

BACKGROUND ART

The use of an extrusion press is known for making metallic material section bars. In this regard, FIG. 1 shows an extrusion press (100) of known type which comprises a supporting structure defined by two crosspieces (110, 120), a front one and a rear one, connected by means of columns (130), typically four in number. A die (M) is positioned at the front crosspiece (110), which confers the shape to the section bar to be extruded.

The material to be extruded is pushed through the die (M) by means of a thrust cylinder (C) integrated into the rear crosspiece, in a position substantially opposite to the die. The rear crosspiece (120) is typically anchored to the ground, while the front crosspiece (110) is arranged on a slide so that the forces are transferred to the rear crosspiece through the columns indicated above instead of being relieved onto the ground (foundation).

The raw material to be extruded is typically in the form of a billet, normally cylindrical. The billet is loaded into a container consisting of a hollow cylindrical body of significant thickness. In turn, the container is placed inside a container-holder element (150) defining a cavity (155) in which the container is permanently housed.

The material is extruded by means of the action of a push rod pushed by the cylinder (C) indicated above. In particular, the push rod is movable between two extreme positions which define its stroke along an extrusion direction (105). The push rod comprises a free end at which a punch, which acts directly on the billet, is mounted. As a result of the thrust applied by the punch, the metal material is extruded through the die taking the shape established by the die itself. When all the metal material of the billet has been extruded, the rod is retracted to allow the loading of a new billet. At the same time, the side of the die facing towards the rod is concerned by the action of a shear which restores the surface thereby eliminating the excess metal material left by the previous extrusion.

The extrusion die (M) is typically housed in a die-holder drawer (160) (see FIG. 2) and is replaced as a function of the shape of the section of the finished product to be obtained. For such a purpose, the press (100) comprises a die-moving assembly (300) (M) capable of moving the die-holder drawer (160) transversely, i.e. in a direction orthogonal to the extrusion axis (105), to allow its replacement. More precisely, the die-holder drawer slides on guides (108), usually made of bronze and oriented precisely in the transverse direction. The guides are installed on a fixed support element (also known as a gib) anchored to the front cross-beam or to the supporting structure of the press. The moving assembly (200) is configured to push/pull the die-holder drawer (160) from a die changing position to a working position, in which the die assembly this expression being used to indicate the drawer and the relative die) is aligned with the extrusion axis (105). When the die changing position is reached, the die itself can be replaced. In most cases, the moving assembly comprises a hydraulic piston but, in some known applications, the use of pneumatic cylinders or electric actuators is provided.

With reference to FIG. 3, in order to guide the movement of the die-holder drawer (160) in the transverse direction (106) in a stable manner, the gib further comprises a transverse guiding element (400) which defines an abutment surface (450) for the die-holder drawer (160). This abutment surface extends on a plane orthogonal to the extrusion axis and in addition to guiding the die-holder drawer (160) fixes its position along the extrusion axis.

Again with reference to FIG. 3, in order to ensure, that the die assembly is aligned with the extrusion axis, shims (109) are typically arranged under the bronze guides (108). As a result of frequent die changes, the guides are subject to wear and therefore it is necessary, at regular intervals, to increase the shims under the bronze guides to ensure the correct vertical position of the die, i.e. to ensure the height centering with the extrusion axis. This operation is rather delicate and must necessarily be performed by specialized personnel, through the use of very accurate measuring instruments. All this results in rather prolonged machine downtimes and therefore in low productivity of the machine.

Additionally, when the guides are completely worn, they must be replaced by new ones which will have the same initial thickness as the previous ones. This leads to the need to eliminate all the shims previously added until that moment. It is apparent that these additional operations also have a major impact on machine downtime and therefore on the operating costs of the machine.

SUMMARY OF THE INVENTION

Given the above considerations, it is the main task of the present invention to provide a press for the extrusion of metal materials which makes it possible to overcome, or at least strongly limit, the drawbacks of the prior art presses as described above. As part of this task, it is a first object to provide a press in which the die replacement operations have a much more limited impact on machine downtime than traditional presses. It is another object of the present invention to provide a press in which the transverse movement of the die-holder drawer does not require complicated manual adjustment operations, such as those currently required for the positioning of the shims under the guides. It is a further object of the present invention to provide a press in which the maintenance costs of the components involved in die replacement are lower than those of the current presses. It is a not last object of the present invention to provide a press in which the position can be adjusted precisely and reliably.

The present invention is based on the consideration that the intended objects can be effectively achieved by avoiding the sliding of the drawer on the surfaces of the supporting elements on which it rests during the extrusion operations and at the same time by providing appropriate elements to support the drawer during its movement in a transverse direction.

In particular, the present invention relates to a press for the direct extrusion of metallic material, wherein said press comprises a supporting structure, defining an extrusion direction of the metallic material, an extrusion die and a die-holder drawer, in which there is places the extrusion die. The press further comprises moving means which move the drawer along a transverse direction, orthogonal to said extrusion axis, between a first position, in which the die is aligned with the extrusion axis, and a second position, in which the die can be replaced. The press according to the invention further comprises a fixed supporting element which supports the drawer at least when it occupies the first position, i.e. during the extrusion process.

The press according to the invention is further characterized in that it comprises at least a movable supporting element for supporting, said drawer during the movement along the transverse direction. The press is further characterized in that it comprises lifting means which lift the movable supporting element between a first vertical position, in which the drawer is supported by the fixed supporting element, and a second vertical position, in which the drawer is lifted with respect to the fixed supporting element and is supported by said at least one movable supporting element.

Advantageously, the sliding of the drawer along the transverse direction takes place along surfaces different from those of the fixed supporting element on which the drawer rests during the extrusion process. Therefore, the supporting surfaces of the fixed supporting element are not affected by the wear arising from the transverse movement of the drawer. This makes it possible to preserve the integrity of such supporting surfaces and therefore to reduce the frequency of maintenance operations.

According to a possible embodiment, the press comprises a number of movable supporting elements to support the drawer during its movement along the transverse direction. The lifting means lift each of the movable supporting parts between the two vertical positions (the first one and the second one).

Preferably, the press comprises a first movable supporting element and a second movable supporting element arranged on opposite sides with respect to the fixed supporting element.

In a possible embodiment, the fixed support element comprises a transverse guide portion defining an abutment surface which extends on a plane substantially orthogonal to the extrusion axis.

According to another aspect, the fixed supporting element comprises at least one resting surface on which the drawer rests and said at least one movable support comprises at least one sliding, surface on which the drawer slides during its movement along the transverse direction.

Preferably, the first contact surface and/or the sliding surface are made of bronze.

According to an embodiment, the fixed supporting element comprises a metal body and a plate made of metallic material fixed to the body, in which this plate defines said supporting surface.

According to a further embodiment, said at least one movable supporting element comprises a metal body and a metal plate fixed to the body, wherein said plate defines said sliding surface. In a possible variant, a shim is placed between the plate of the movable supporting element and the corresponding body.

According to a possible embodiment, the lifting means comprises one or more hydraulic actuators.

According to another aspect, the press is provided with locking means to permanently lock the drawer in the first position, wherein said locking means are configured to prevent vertical movements of the drawer.

BRIEF DESCRIPTION OF THE FIGURES

Further features and advantages of the present invention will be apparent in light of the detailed description of preferred, but not exclusive, embodiments of a press for the extrusion of metallic material according to the present invention as illustrated by way of non-limiting example, with reference to the accompanying drawings, in which:

FIG. 7 is a partial cross-section side view of the press in FIG. 4 in a second operating configuration;

In Figures from 4 to 7, the same reference numerals and letters are used to identify the same elements or components.

DETAILED DESCRIPTION OF THE INVENTION

Figure 1:
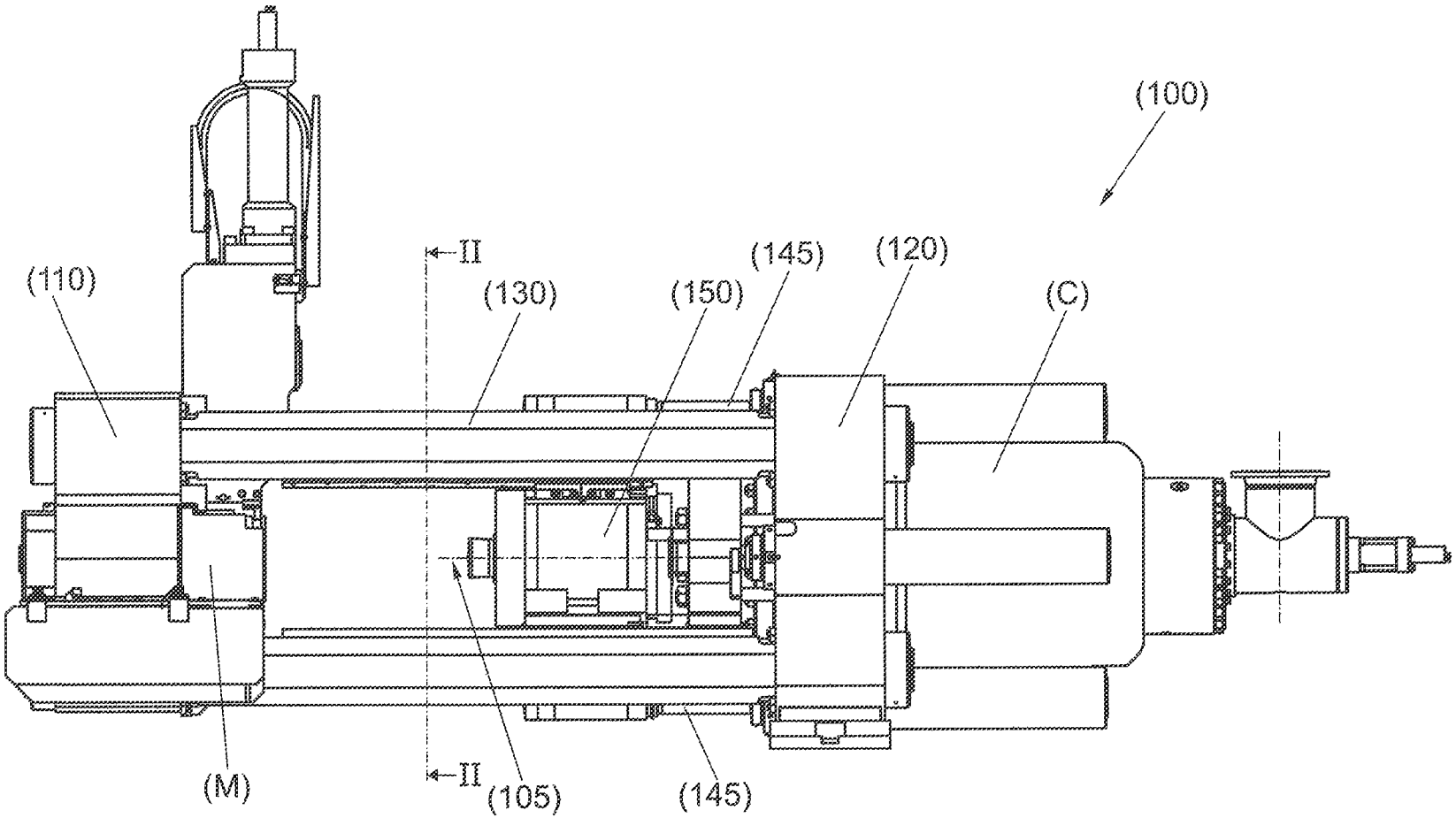
FIG. 1 is a view of a press of known type.
Figure 2:
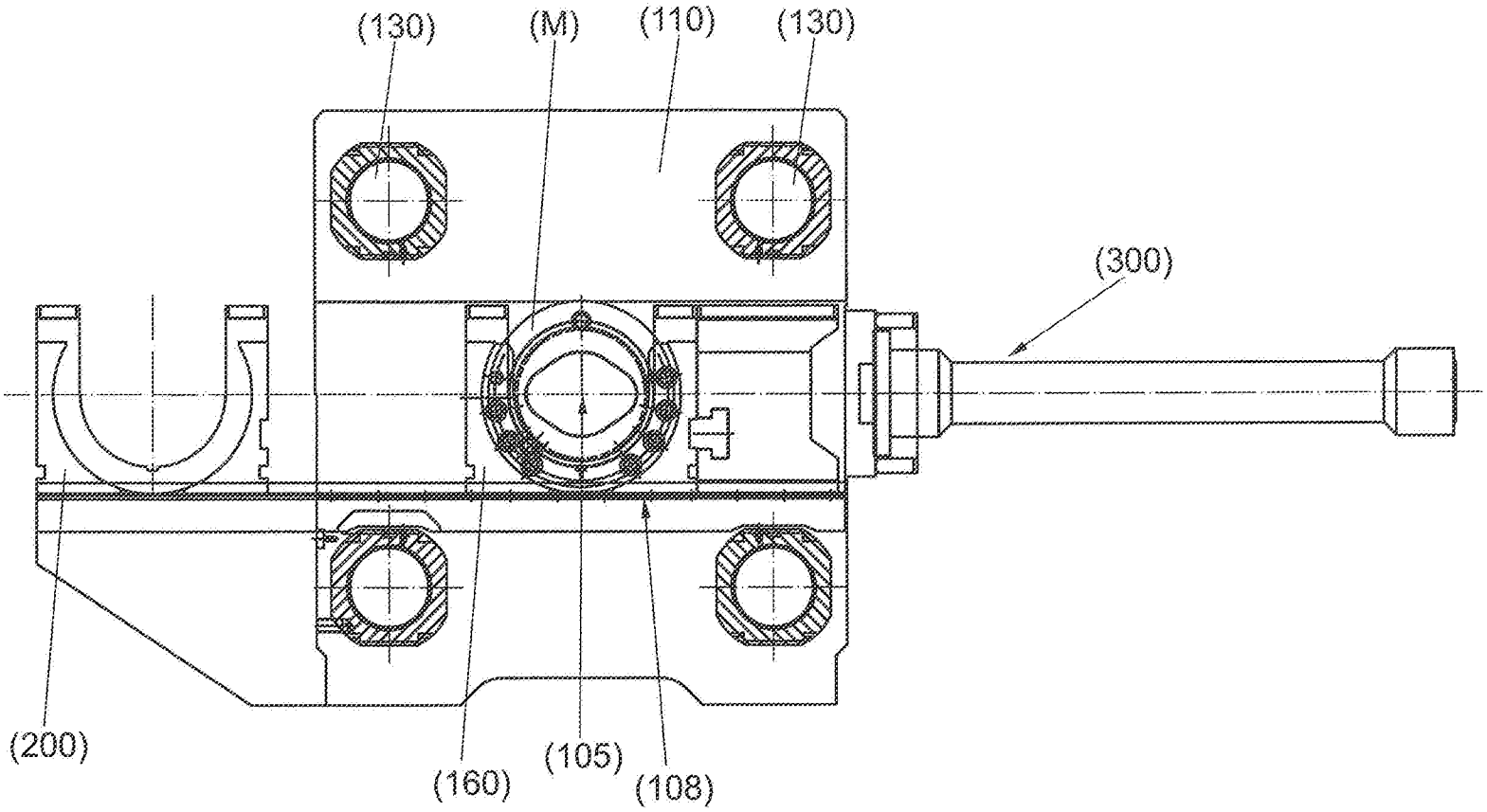
FIG. 2 is a section view taken along section plane II-II in FIG. 1.
Figure 3:
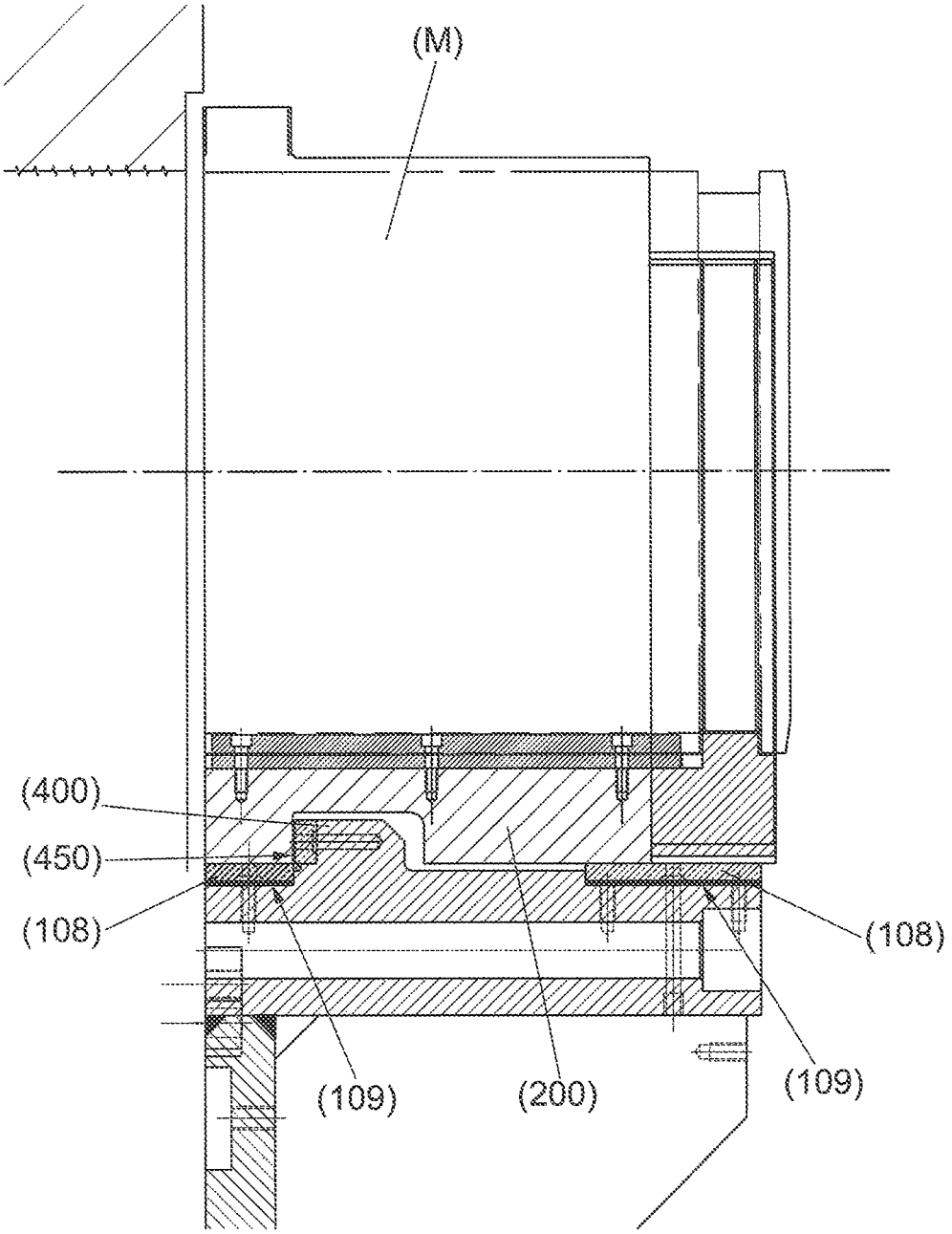
FIG. 3 is a partial cross-section, detail view of some components of the press in FIG. 1.

With reference to FIGS. 4 to 7, the present invention relates to a press (generically indicated by reference numeral 1) for the extrusion of metallic material, particularly but not exclusively for the extrusion, of aluminum. The press 1 comprises a supporting structure 10, which defines an extrusion direction 500 along which the metal material is extruded through a die 2. According to a principle known in itself, the die 2 confers the shape of the section of the metal profile generated by the extrusion.

Figure 4:
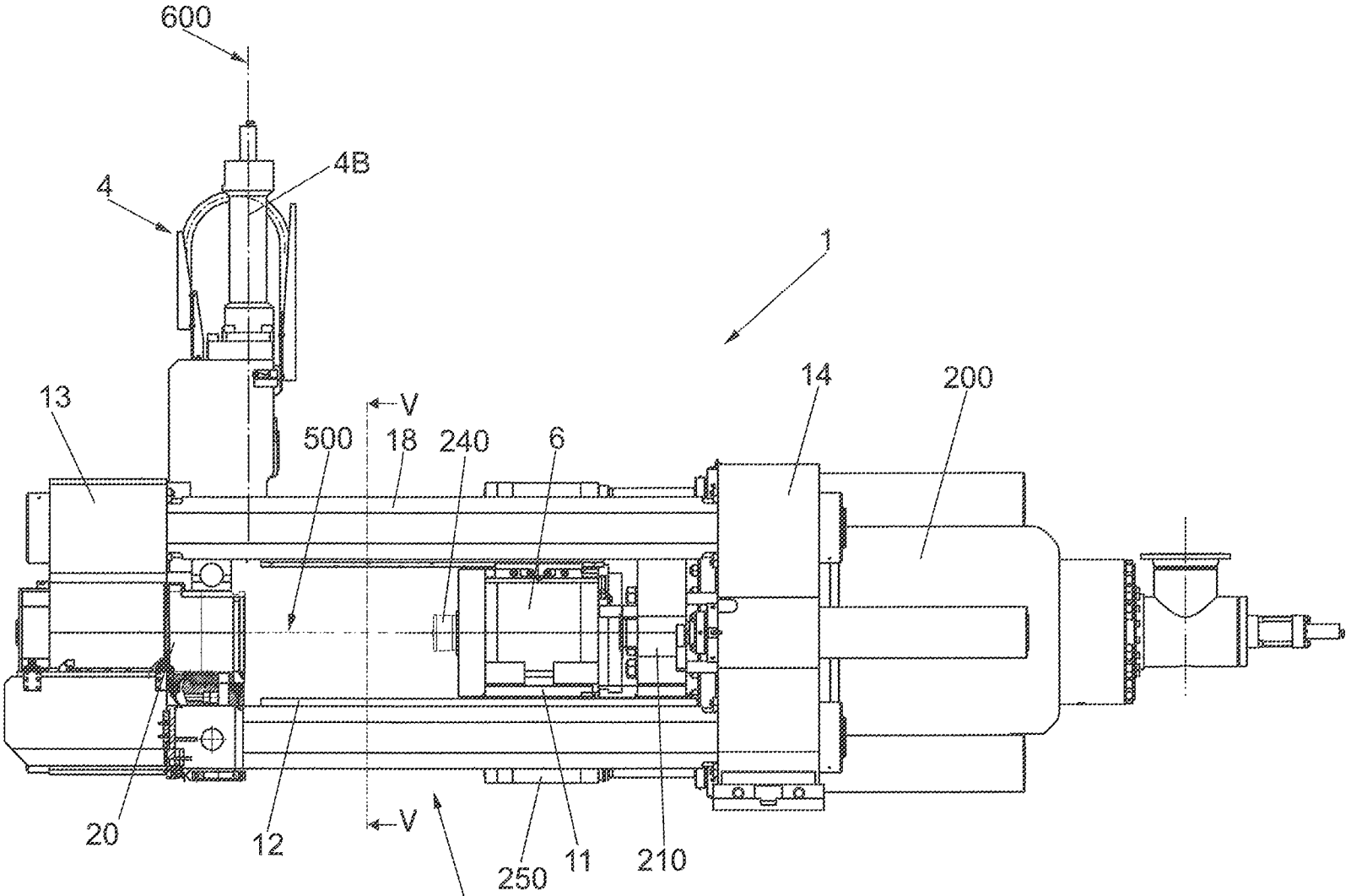
FIG. 4 is a view of a press according to the invention.

The supporting structure 10 has a configuration known in itself comprising a first crosspiece 13, near which an extrusion die 2 is placed (hereinafter also referred to as "die 2"), and a second crosspiece 14 in a position distanced from said die 2. The two crosspieces 13, 14 are connected by columns 18 which develop in parallel defining the extrusion direction 500. With particular reference to FIG. 4, the press 1 comprises a thrust cylinder 200, integral to the second crosspiece 14, which generates the force necessary to extrude the material. In particular, the cylinder 200 moves a rod 210 provided, at its free end, with a punch 240 which acts on the material to be extruded, according to a widely known principle.

The press 1 comprises a container 5 inside which the metal material to be extruded is loaded. Preferably, the container is defined by a cylindrical hollow body which contains the billet in a plastic state. The container 5 is supported by a container holder 6 which rests on a plurality of pads 11, preferably two. These pads 11 slide along corresponding guides 12 fixed to the supporting structure 10 and parallel to the extrusion direction 500. Therefore, the container-holder 6 also slides parallel to the extrusion direction 500. In this regard, appropriate thrust cylinders 250 are provided to allow the movement of the container-holder along the extrusion direction 500.

The press 1 according to the invention comprises a die-holder drawer 20 (hereinafter also referred to as "drawer 20") in which the die 2 is placed. The drawer 20 is movable along a transverse direction 600 between at least a first and a second position (identified by P1 and P2 in FIG. 5). For the purposes of the present invention, the expression "transverse direction 600" means a direction substantially orthogonal to a vertical plane containing the extrusion axis 500. In the first position P1, the die 2 is aligned with the extrusion axis 500, i.e. in such a condition that the extrusion operation can be started. On the other hand, the second position P2 is set so that the die 2 can be easily extracted and replaced. Preferably, the second position. P2 is such that the drawer 20 is substantially outside the volume delimited by columns 33 of the supporting structure 10 (condition shown in the right part of FIG. 5).

The drawer 20 is moved along the transverse direction 600 using moving means 4. Preferably, the latter comprises an actuator 4B which moves a rod 4C connected, either directly or indirectly, to the drawer 20 so that a displacement of the rod 4C results in a corresponding displacement of the drawer 20.

The press 1 according to the invention further comprises at least one fixed supporting element 30 which supports the drawer 20 at least when it occupies the first position P1 indicated above. In particular, the fixed supporting element 30 comprises a resting surface 31 for the drawer 20. In accordance with an embodiment depicted in the figures, the fixed supporting element 30 comprises a metallic material body 34 connected to the front crosspiece 13 by means of appropriate fixing means 39 (shown in FIG. 6). The fixed supporting element 30 further comprises a plate 31B, preferably made of bronze, which is fixed to the body 34 and which defines the supporting surface 31.

The press 1 according to the invention further comprises at least one movable supporting element 40,50 which supports the drawer 20 during the movement along the transverse direction 600. Said at least one movable supporting element 40,50 comprises a body 44,54 to which a plate 41B,51B made of metallic material, preferably bronze, is fixed. Such a plate 41B,51B defines a sliding surface 41,51 for the drawer 20.

The press 1 according to the invention comprises lifting means 70 for lifting the movable supporting element 40,50 between a first and a second position (indicated respectively by V1 and V2 in FIGS. 6 and 7), wherein said positions are determined according to a vertical direction, i.e. orthogonal to the extrusion axis 500 and to the transverse direction 600. In particular, the first position V1 (hereinafter also the first vertical position V1) is such that the drawer 20 is supported only by the fixed supporting element 30 and in particular on the supporting surface 31. The latter basically determines the vertical position of the drawer 30 and thus of the die 2 housed therein. Therefore, the contact surface 31 of the fixed supporting element 30 establishes the alignment condition of the die 2 with the extrusion axis 500.

The second position V2 (hereinafter also indicated as second vertical position V2) is such that the drawer 20 is only supported by the movable supporting element 40,50 and therefore no longer rests on the supporting surface 31 of the fixed supporting element 30. Basically, when the second vertical position V2 is reached, the drawer 20 is raised in relation to the fixed supporting element 30. As described in greater detail below, according to the invention, the transverse movement 800 of the drawer 20 is achieved precisely when the movable supporting element 40,50 occupies the second position V2. In this manner, the drawer 20 slides only on the sliding surface 41B,51B of the mobile supporting element 40,50 without concerning the supporting surface 31 of the fixed supporting element 30. This solution thus limits wear of the contact surface 31 and considerably increases its service life.

Figure 6:
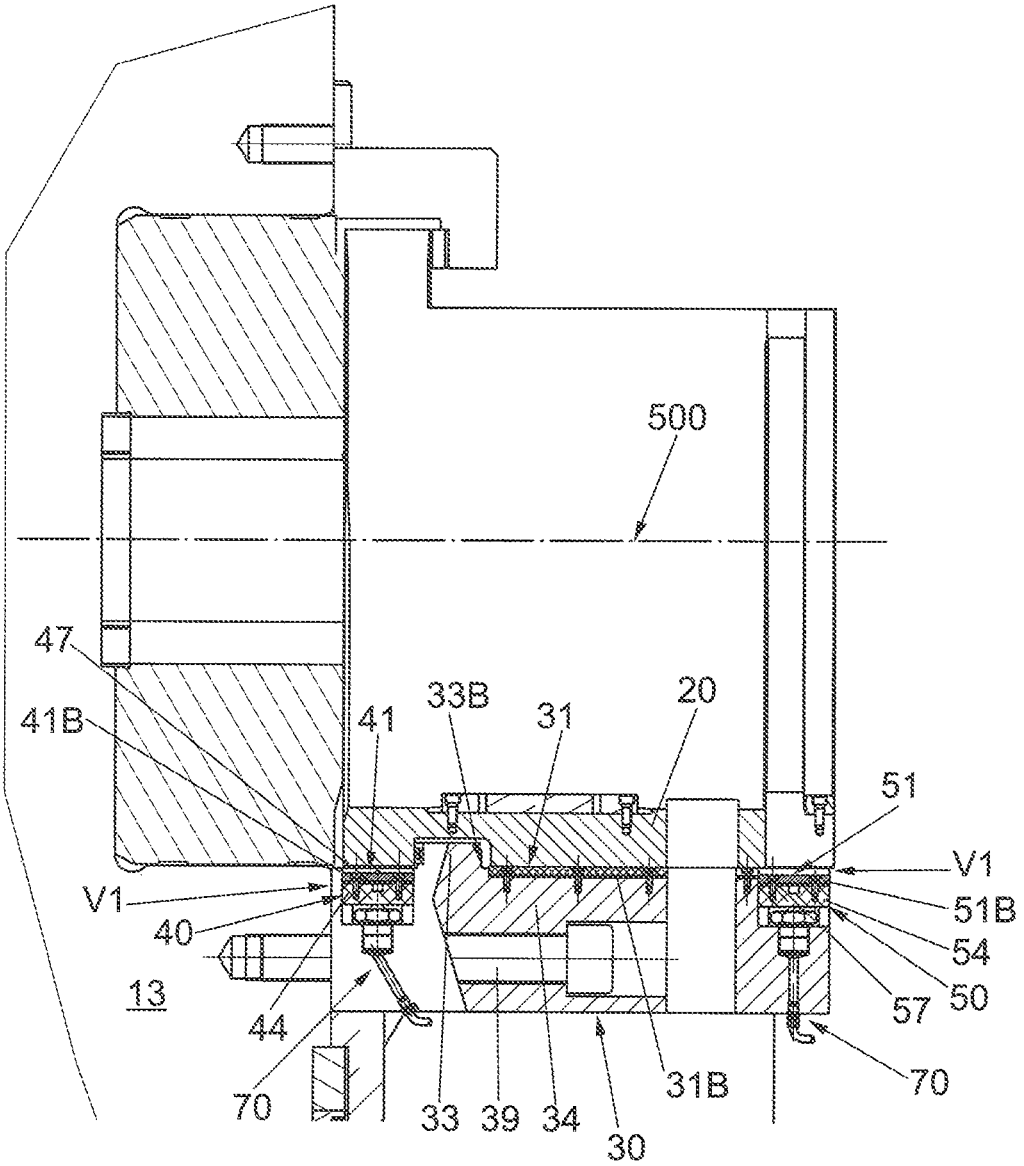
FIGS. 6 and 7 are partial cross-section side views of the press in FIG. 4 in two different first operating configurations.
Figure 7:
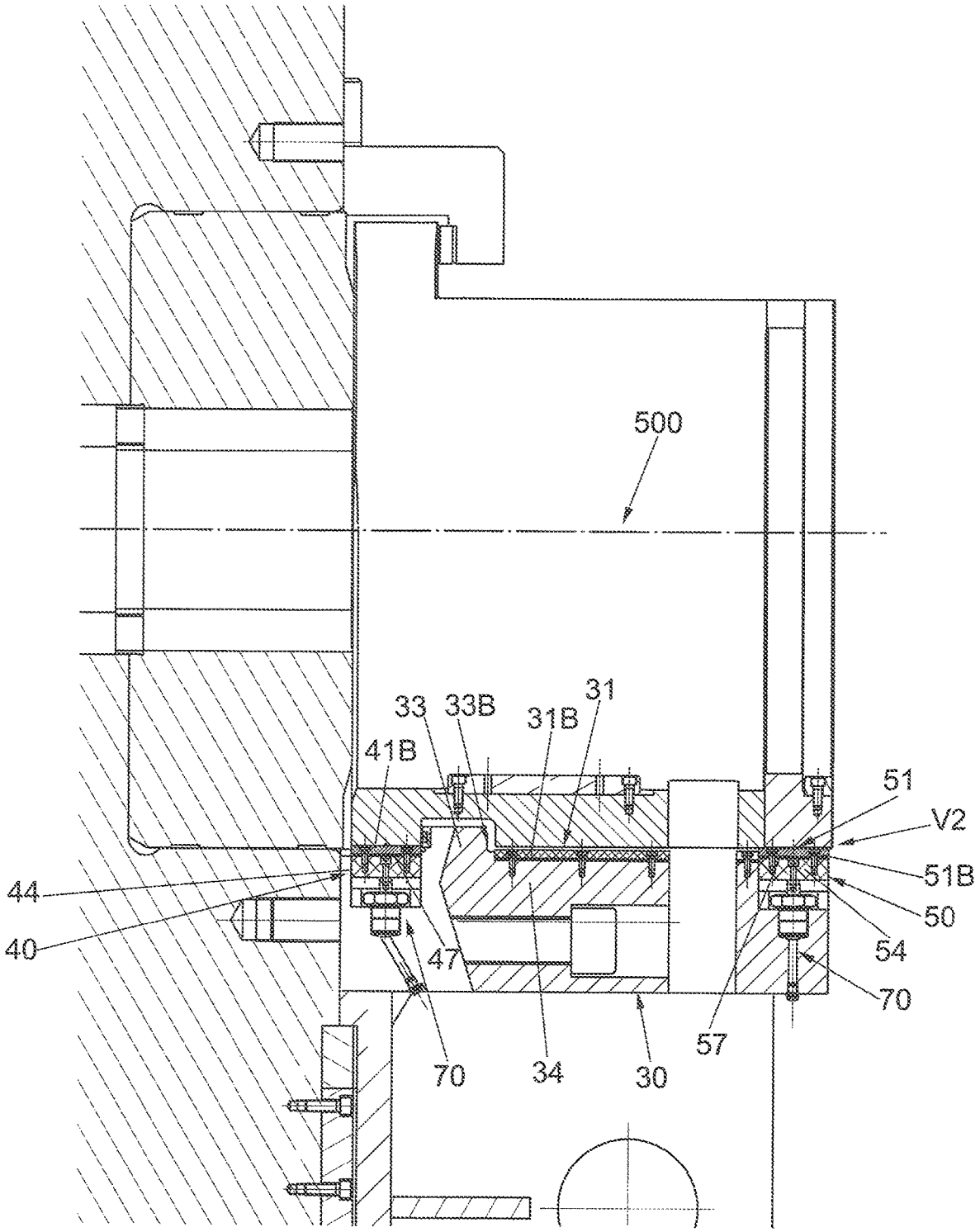

According to a preferred embodiment, shown in particular in FIGS. 6 and 7, the press 1 comprises a first movable supporting element 40 and a second movable supporting element 50 having precisely the function of supporting the drawer 20 during its movement along the transverse direction 200. Preferably, the two movable supporting elements 40,50 are arranged on opposite sides of the fixed supporting element 30. Preferably, the two movable supporting elements 40,50 both have the configuration described above defined by a body 44,54 and a plate 41B,51B made of metallic material, preferably bronze, fixed to the body 44,54 and which defines a corresponding sliding surface 41B,51B for the drawer 20.

According to a possible embodiment, for one or both movable elements 40,50, a shim 47,57 may be placed between the corresponding body 44,54 and the corresponding plate 41B,51B. In any case, these shims 47,57 do not require frequent replacement because they do not contribute to the alignment of the die 2 with extrusion axis 500.

According to a possible embodiment shown in the figures, the lifting means comprises a number of hydraulic actuators 70 configured so as to provide a sufficient force to lift the movable supporting elements 40,50 and the drawer 20 which runs along them. According to an alternative embodiment, the hydraulic actuators 70 could be replaced by electric or even by pneumatic actuators.

According to another aspect, the fixed supporting element 30 comprises a guide portion 33 defining a transverse guide 33B which extends on a plane which is substantially orthogonal to the extrusion axis 500. This transverse surface 33B establishes a guide for the movement of the drawer 20 and allows the drawer itself to move stably along the transverse direction 600. At the same time, the transverse surface 33B defines the position of the drawer 20 along the extrusion axis 500.

FIGS. 6 and 7 show the basic moving principle of the drawer 20 along a transverse direction. During the normal operation of the press 1, i.e. during the step of extruding of the metal material, the drawer 20 is placed only on the supporting surface 31 of the fixed supporting element (condition in FIG. 6). In this condition, the two movable supporting elements 40,50 are placed in the first vertical position V1 and do not offer any support to the drawer 20. The die 2 is aligned with extrusion axis 500 as a result of the height established by the support surface 31 of the fixed supporting element 30.

When the die 2 must be replaced, the lifting means 70 are activated to take the supporting moving parts 40,50 to the second vertical position V2. During their movement towards the second vertical position V2, the two movable supporting elements 40,50 lift the drawer 20 with respect to the supporting surface 31 of the first supporting element 30. In this manner, the supporting surface 31 remains free and is not concerned by the subsequent movement of the drawer 20 (condition shown in FIG. 7).

Once the two movable supporting elements 40,50 have reached the second vertical position V2, the moving means 4 are activated to push the drawer 20 from the working position (first position P1) to the die change position (second position P2). Therefore, during this step, the drawer 20 slides only along the sliding surfaces 41,51 of the two moving, support elements 40,50. Thus, during the transverse movement of drawer 20, there is no contact between the drawer 20 and the contact surface 31 of the fixed supporting element 30. The integrity of such supporting surface 31 is so preserved for the benefit of greater durability.

According to another aspect, the press 1 according to the invention further comprises locking means to stably lock the drawer 20 in the first predetermined position P1. More precisely, these locking means act on the die 2 to counteract the vertical movements which may be induced on the die itself following due to the action exerted by the shear at the end of the extrusion of the billet and before the extrusion of the next one.

Figure 5:
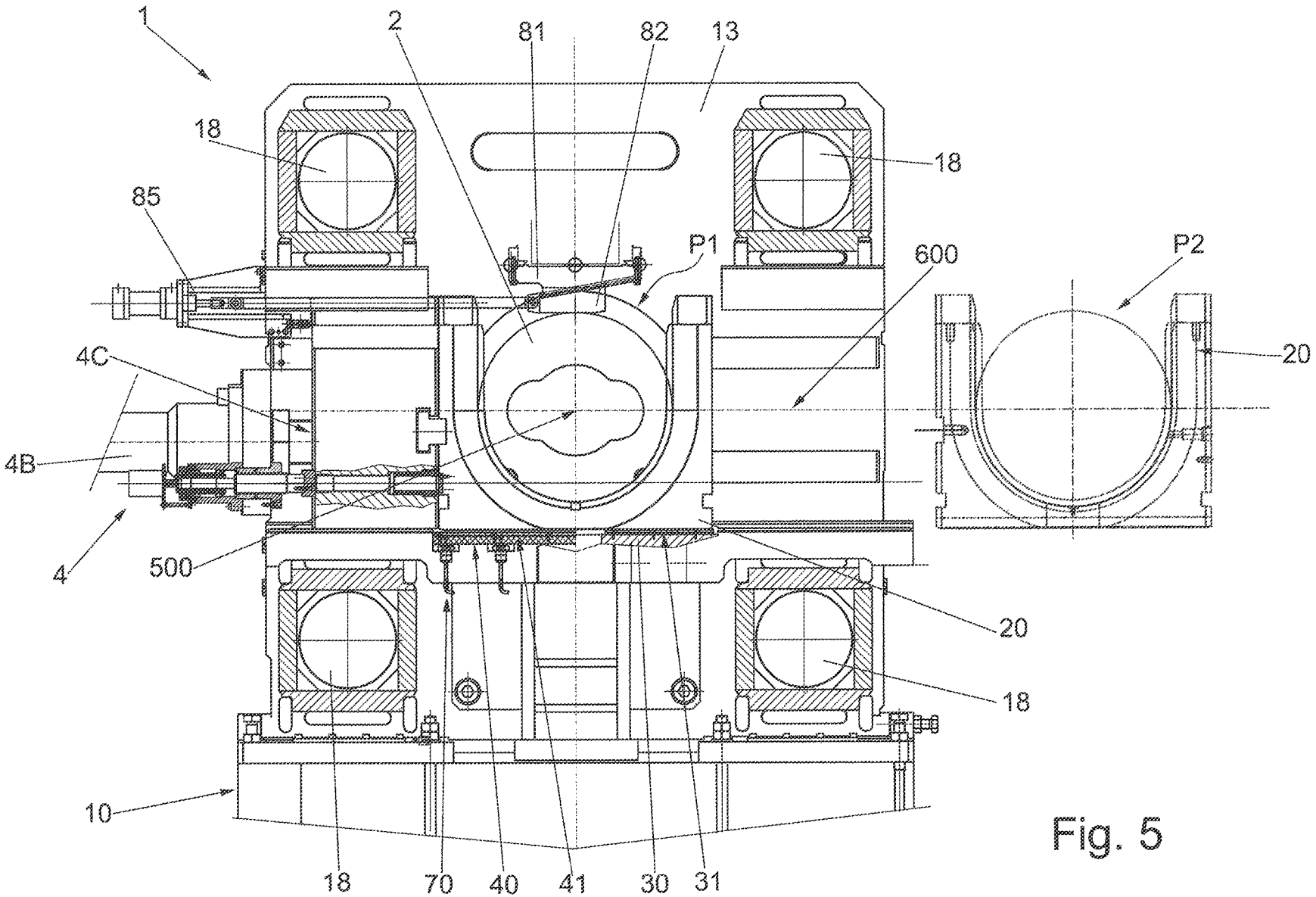
FIG. 5 is a section view taken along line V-V in FIG. 4.

In an embodiment shown in FIG. 5, such locking means comprise a first wedge-shaped element 81 attached to the front crosspiece 13 on the side which faces the die 2. The locking means further comprise a second wedge-shaped element 82 which is movable along the transverse direction 600 through the action of an actuator 85, e.g. of the hydraulic type. The two elements 81,82 each comprise an inclined surface which confers wedge shape to them.

The two elements 81,82 are operationally coupled by means of their inclined surfaces so that the second element 82 slides with respect to the first element 81. A portion of the second element 82 comes into contacts with the top of the die 2. As a result of such a coupling, following the displacement along the transverse direction 800 in a predetermined direction (leftwards in the solution shown in FIG. 5), the second element 82 applies vertical pressure on the die 2, forcing it against the supporting surface 31 of the fixed supporting element 30. In this manner, movements which could be induced by the movement of the shear in contact with the surface of the die are avoided, especially during the upward step of the shear, are avoided.

Although the present invention is explained above by means of a detailed description of the embodiments thereof shown in the drawings, the present invention is obviously not limited to the embodiments described above and shown on the drawings. On the contrary, all the modifications and/or variants of the embodiments described above and shown in the drawings which will appear obvious and immediate to a person skilled in the art are included in the scope of the present invention.

The invention claimed is:

1. A press for the direct extrusion of metallic material, wherein said press comprises:

a supporting structure which defines an extrusion axis of said metallic material and a transverse direction orthogonal to a vertical plane containing said extrusion axis;

an extrusion die;

a die-holder drawer in which said die is placed;

moving means for moving said drawer along said transverse direction between a first position (P1), in which said die is aligned with said extrusion axis, and a second position in which, when reached, said die can be replaced;

a fixed supporting element which supports said drawer at least when it occupies said first position (P1), at least a movable supporting element for supporting said drawer during the movement along said transverse direction;

lifting means for vertically lifting said at least one movable supporting element between a first vertical position (V1), in which said drawer is supported by said fixed supporting element, and a second vertical position, in which said drawer is lifted with respect to said fixed supporting element and supported by said at least one movable supporting element;

a plurality of movable supporting elements for supporting said drawer during its movement along said transverse direction, wherein said lifting means lift each of said movable supporting elements between said vertical positions (V1,V2);

a first movable supporting element and a second movable supporting element arranged on opposite sides with respect to said fixed supporting element;

wherein said fixed supporting element comprises a transverse guide portion defining an abutment surface which extends on a plane substantially orthogonal to said extrusion direction;

wherein said fixed supporting member comprises at least one resting surface on which said drawer rests and wherein said at least one movable support comprises at least one sliding surfacon which said drawer slides during its movement along said transverse direction;

wherein said fixed supporting element comprises a body made of metallic material and a plate made of metallic material fixed to said body, wherein said plate defines said resting surface.

2. The press according to claim 1, wherein said first resting surface and/or said sliding surface is made of bronze.

3. The press according to claim 1, wherein said at least a movable supporting element comprises a body made of metallic material and a plate fixed to said body, wherein said plate defines said sliding surface.

4. The press according to claim 3, wherein a shim is interposed between said plate and said body.

5. The press according to claim 1, wherein said lifting means comprise one or more hydraulic actuators.

6. The press according to claim 1, wherein said press comprises locking means for stably locking said drawer in said first position (P1), wherein said locking means are configured to prevent vertical displacements of said extrusion die in said drawer.

* * * * *